US007562917B2

(12) United States Patent
Kohlstrand et al.

(10) Patent No.: US 7,562,917 B2
(45) Date of Patent: Jul. 21, 2009

(54) DOOR LATCH SYSTEM FOR AUTOMOTIVE VEHICLE

(75) Inventors: Kelly Kohlstrand, Grosse Ile, MI (US); Xiang Dong Yu, Ann Arbor, MI (US); Stanley Liu, Livonia, MI (US); Tad Siedlecki, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 192 days.

(21) Appl. No.: 11/306,757

(22) Filed: Jan. 10, 2006

(65) Prior Publication Data

US 2007/0170727 A1 Jul. 26, 2007

(51) Int. Cl.
*E05B 3/00* (2006.01)

(52) U.S. Cl. ..... 292/336.3; 292/216; 292/DIG. 42; 292/DIG. 25

(58) Field of Classification Search ..... 292/336.3, 292/201, 216, DIG. 42, DIG. 25, DIG. 23; 70/256, 247; 74/500.5, 502
See application file for complete search history.

(56) References Cited

U.S. PATENT DOCUMENTS 3,831,409 A * 8/1974 Gebhard et al. ..... 70/241
4,773,683 A 9/1988 Nakamura
4,986,098 A 1/1991 Fisher
4,995,654 A 2/1991 Nishigami et al.
4,998,758 A * 3/1991 Kowalczyk et al. ..... 292/201
5,233,849 A 8/1993 Forbers
5,423,582 A 6/1995 Kleefeldt
5,537,848 A 7/1996 Grzanka et al.
5,852,943 A 12/1998 Dutka et al.
5,996,382 A 12/1999 Lehmkuhl
6,079,757 A 6/2000 Aubry
6,112,564 A * 9/2000 Rathmann et al. ..... 70/279.1
6,116,664 A 9/2000 Wegner
6,247,732 B1 6/2001 Alton
6,264,257 B1 * 7/2001 Meinke ..... 292/336.3
6,530,251 B1 * 3/2003 Dimig ..... 70/237
6,598,436 B2 * 7/2003 Ponn et al. ..... 70/256
6,715,806 B2 4/2004 Arlt et al.
7,192,076 B2 * 3/2007 Ottino ..... 296/146.1
2004/0262928 A1 12/2004 Fukunaga et al.

* cited by examiner

*Primary Examiner*—Peter M. Cuomo
*Assistant Examiner*—Mark Williams
(74) *Attorney, Agent, or Firm*—Dickinson Wright PLLC; Greg Brown

(57) ABSTRACT

A door latch system for an automotive vehicle uses a push-pull cable linked to a lock cylinder and to a latch to move the latch assembly into the locked position while simultaneously blocking the latch's lock/unlock lever from moving into the unlocked position.

10 Claims, 6 Drawing Sheets

DOOR LATCH SYSTEM FOR AUTOMOTIVE VEHICLE

TECHNICAL FIELD

The present invention relates to a system for using flexible cables having a positive locking feature, rather than rod linkages, for operating certain features of an automotive door latch.

BACKGROUND

Conventional automotive latch assemblies often employ a mixture of flexible cables for actuating the latch, combined with rigid rod linkages for driving the lock/unlock function of the latch. A problem with rod linkages arises from the fact that such linkages are susceptible to tampering by thieves, who are sometimes able to open the door of a vehicle by applying a tool to a rigid linkage so as to move the door latch to its unlocked position. A system according to the present invention obviates this problem because the push-pull cable used to move the latch assembly into and out of the locked position is resistant to manipulation by means of a jimmying tool. Moreover, with the present inventive lock system, when the latch has been moved into the locked position, a blocker pin prevents the lock from being jimmied into the unlocked state. This results in part because attempts to jimmy the latch will cause the key cylinder to separate from an enclosed component containing the locking/unlock mechanism, thereby preventing unauthorized actuation of the lock assembly.

SUMMARY

A door latch system for an automotive vehicle includes a latch assembly attached to a door, with the latch having a primary lock/unlock lever with a locked position and an unlocked position. A lock cylinder extends through an outer surface of the door. A primary push-pull cable has a first end linked to the lock cylinder and a second end linked to the primary lock/unlock lever. The present system further includes a blocker pin, actuated by the primary push-pull cable, for engaging a portion of the latch system so as to prevent movement of the primary lock/unlock lever into the unlocked position. The blocker pin is secured upon a slider driven by the push-pull cable. The slider is also linked to the primary lock/unlock lever.

The portion of the latch system engaged by the blocker pin includes a secondary lock/unlock lever pivotably mounted to the latch assembly and slaved to the primary lock/unlock lever.

A door latch system according to the present invention also includes an interior latch unlocking cable attached to the slider. The primary push-pull cable and the interior latch unlocking cable are connected to each other by means of interfacing end fittings. In a preferred embodiment, the two cables share a common design with a metallic core and separate, tubular, flexible generally cylindrical housings. The slider itself is housed within a carrier attached to the latch assembly. The carrier includes a channel-shaped enclosure having opposite sidewalls for supporting the slider for reciprocating motion, with the sidewalls having apertures permitting passage of the blocker pin and a linkage terminal integral with the slider and carrying a link extending to the primary lock/unlock lever.

The present door latch also has an interior latch release cable driven by a handle. The secondary lock/unlock lever is redundantly driven by a manually accessible plunger extending through an interior surface of the door.

The flexible cylindrical outer housing of the primary push-pull cable is attached to a retainer at the lock cylinder such that the flexible housing will detach from lock cylinder in the event that the tubular flexible housing is moved translationally.

According to another aspect of the present invention, a method for locking a door latch system for an automotive vehicle includes the steps of engaging a key with a lock cylinder extending through an outer surface of a vehicle door, and manually rotating the lock cylinder with the key so as to actuate a primary push-pull cable attached to the latch assembly. The primary push-pull cable is used to move a lock/unlock lever associated with the latch assembly into a locked position, while simultaneously moving a blocker pin into a blocking position with respect to a portion of the latch assembly slaved to the lock/unlock lever, such that the lock/unlock lever is prevented from moving out of the locked position. According to another aspect of this method, the portion of the latch blocked by the blocker pin includes a lever pivotably mounted to the latch assembly and linked to a manually accessible plunger extending through an inner surface of the door.

According to yet another aspect of the present invention, the key and lock cylinder may be supplanted by any other type of linear lock driver or actuator known to those skilled in the art and suggested by this disclosure, such as various solenoid and motor drives used in other types of automotive locking systems.

It is an advantage of latch system according to the present invention that enhanced vehicle security is provided because the present system is very resistant to unauthorized opening of the vehicle door.

It is another advantage of the present invention that the use of flexible cables extending between the lock cylinder and the latch and the interior latch unlocking handle allow design freedom for the placement of an interior unlocking handle and exterior key cylinder which would not otherwise be present were solid linkages or rods to be used for these functions.

Other advantages, as well as features and objects of the present invention, will become apparent to the reader of this specification.

DETAILED DESCRIPTION OF THE PREFERRED EMBODIMENT

Figure 1:
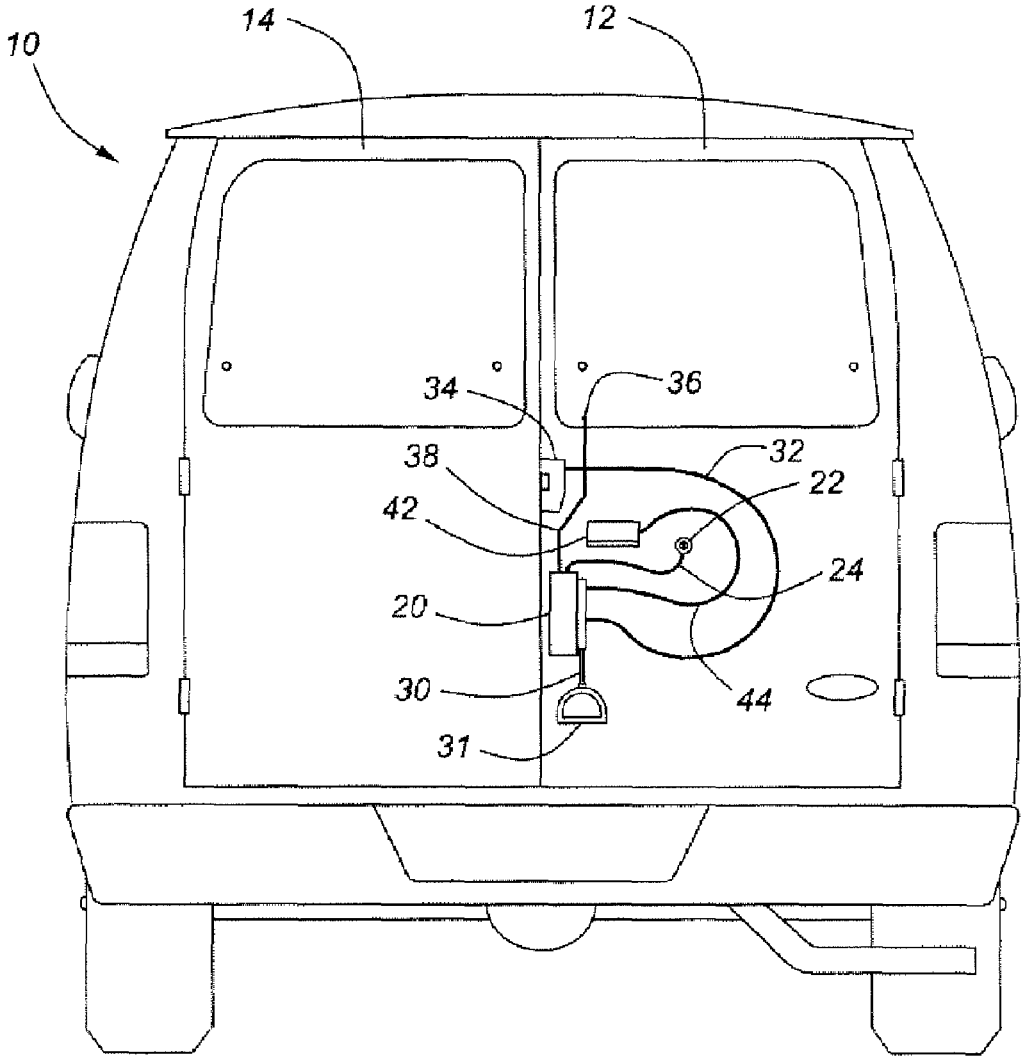
FIG. 1 is a rear elevation of a van-type vehicle having a door latch system according to the present invention.

In the following figures the same reference numerals will be used to illustrate the same components.

Figure 6:
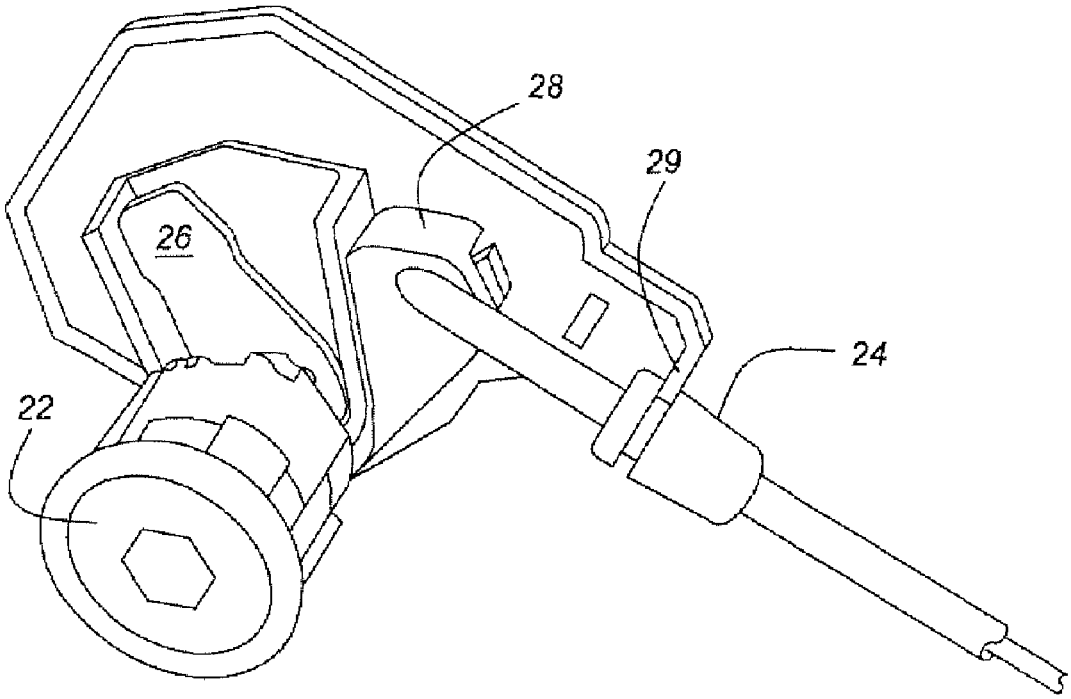
FIG. 6 is a perspective view of a lock cylinder and associated primary push-pull cable and housing assembly.

As shown in FIG. 1, vehicle 10 has two rear doors, 12 and 14. Latch assembly 20 latches door 12 to door 14. Latch assembly 20 has a number of operating devices such as look cylinder 22, which is connected with latch 20 by means a housing assembly containing primary push-pull cable 24. As shown in FIG. 6, lock cylinder 22 drives crank 26 and follower 28, which are connected with push-pull cable 24. Follower 28 and push-pull cable 24 are housed in housing assembly 40. Lock cylinder 22 is clipped to housing cover plate 29 (FIG. 6) by means of lugs 22*a* such that tampering or jimmying of lock cylinder 22 will cause the lock cylinder to become detached from the cable housing assembly.

Latch assembly 20 is also operated by means of interior latch unlocking cable 30, which is actuated by means of cable handle 31. Interior latch release cable 32 is in turn driven by interior latch release handle 34. Rod 36 is mounted for vertical reciprocation, so as to provide interior locking/unlocking capability for latch 20. Exterior latch release handle 42 is attached to latch 20 by means of exterior latch release handle cable 44.

Figure 2:
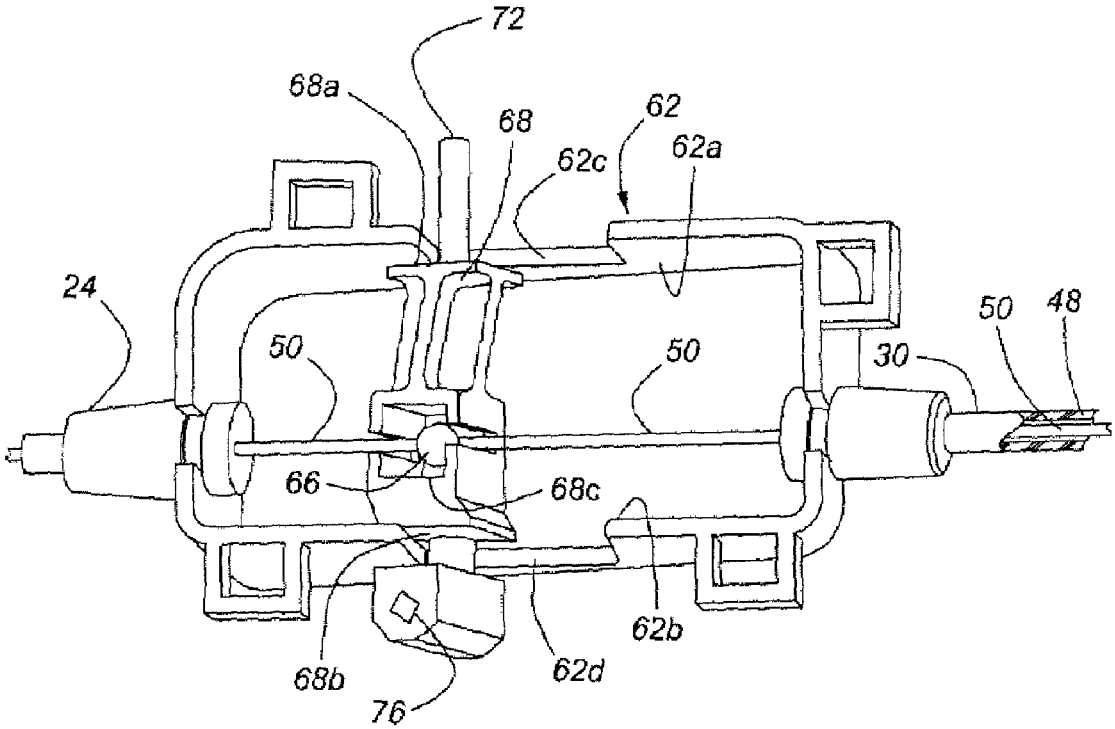
FIG. 2 is a perspective view of a lock slider and carrier according to one aspect of the present invention.
Figure 3:
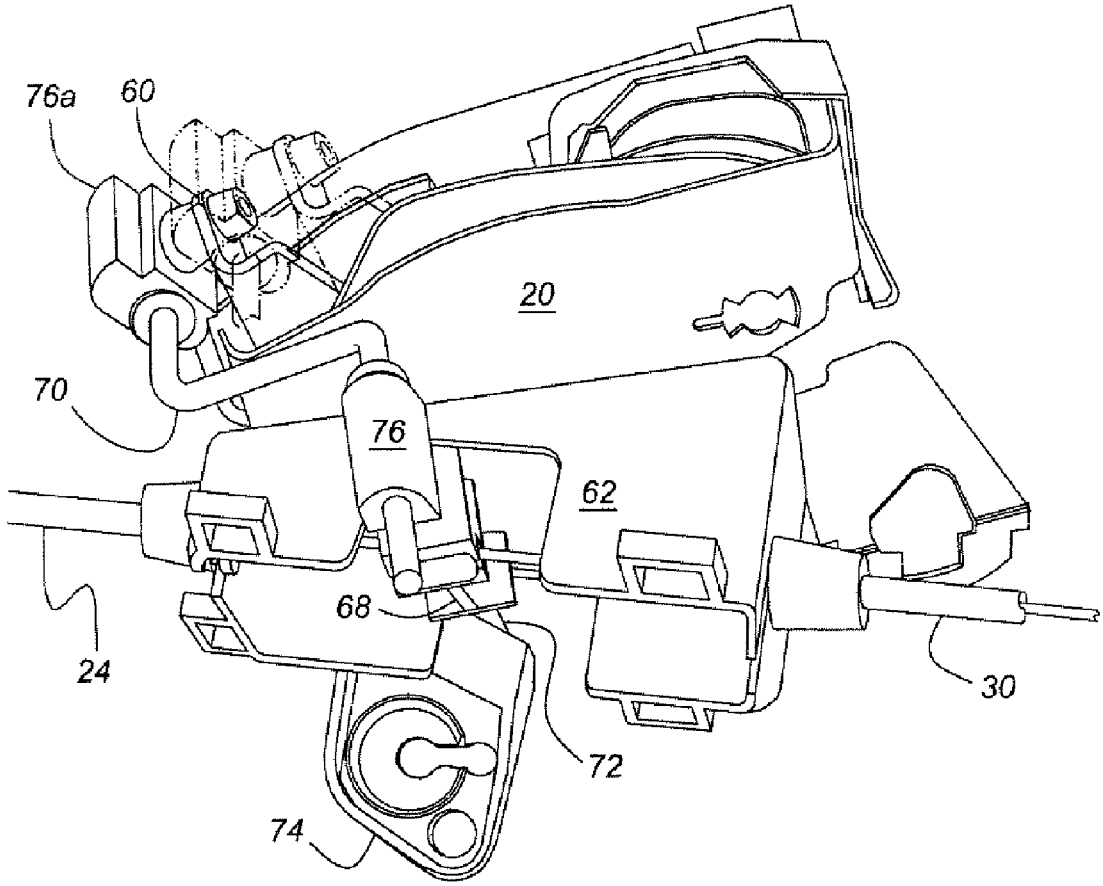
FIG. 3 is a perspective view of a door latch, combined with the slider and carrier of FIG. 2.

As shown in FIG. 2, each of cables 24 and 30 has a plastic sheath, 48, with a metallic core, 50. FIG. 2 shows carrier 62, which as shown in FIG. 3, is attached to an outer portion of latch assembly 20. In the interest of clarity, carrier 62 is shown in FIG. 3 as being displaced from latch assembly 20. Carrier 62 has integral molded runners, 62*a* and 62*b*, which form a support channel for slider 68 as it moves. Slider 68 to moves reciprocally within carrier 62 (FIG. 2) in response to forces imposed by primary push-pull cable 24 and interior latch unlocking cable 30.

Actuation of cable handle 31 causes slider 68 to move from its locked position to its unlocked position. Slider 68 is attached to metallic core 50 of interior latch unlocking cable 30 and is preloaded by spring 66, which urges cable handle 31 to return to its rest position. Ferrule 71 is attached to metallic core 50 of cable 24, and pressed onto slider 68, to assure that reciprocating movement of cable 24 is accurately translated into reciprocating movement of slider 68.

Slider 68 is integral with blocker pin 72 and linkage terminal clip 76. Blocker pin 72 extends through aperture 62*c*, whereas linkage terminal clip 76 extends through aperture 62*d*.

Moving now to FIG. 3, linkage terminal clip 76 (which is shown in its open position) is shown as receiving linkage rod 70, which engages primary lock/unlock lever 60. Primary lock/unlock lever 60 has a locked position shown in ghost view of FIG. 3 and an unlocked position shown in the solid view of FIG. 3. Primary lock/unlock lever 60 is moved from the unlocked to locked position by means of primary push-pull cable 24; lever 60 may also be moved to the unlocked position by means of cable 30.

Figure 4:
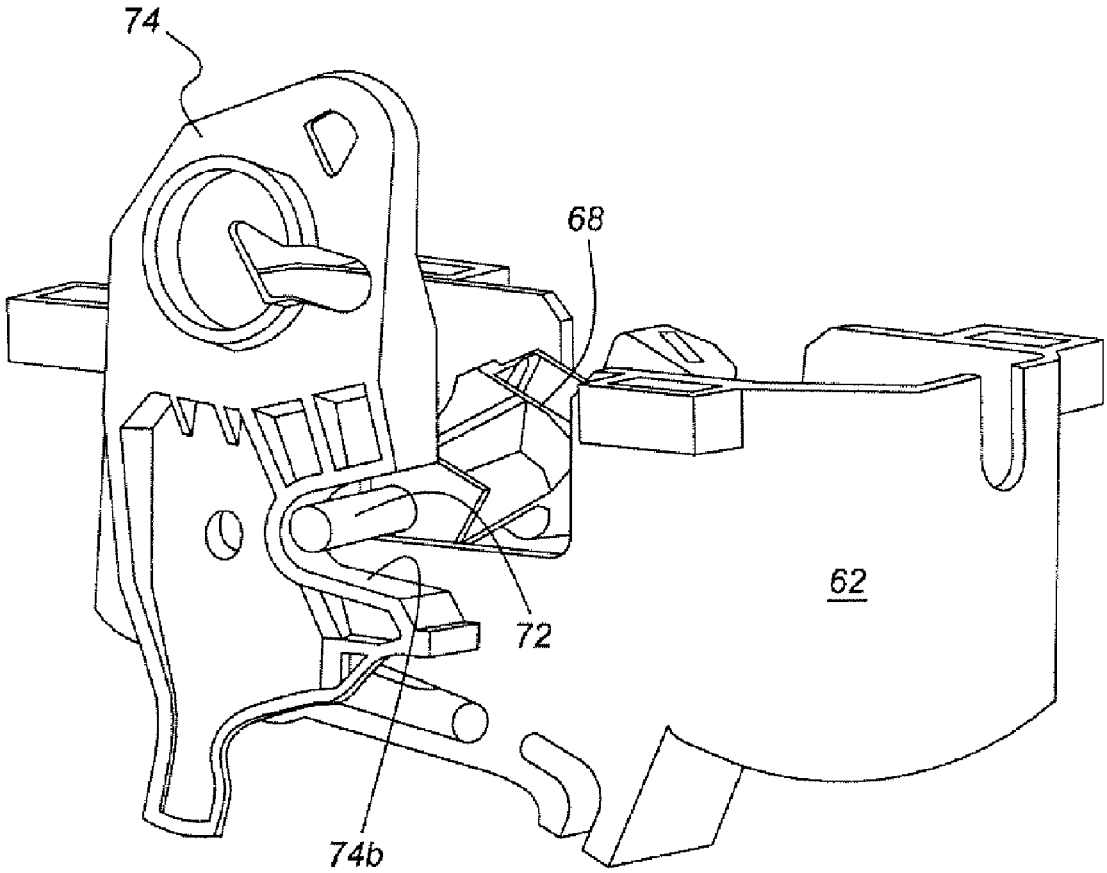
FIG. 4 is a perspective view showing a blocking pin according to the present invention.

Turning now to FIG. 4, secondary lock/unlock lever 74 is shown as being subject to blocking from blocker pin 72. Because primary lock/unlock lever 60 and secondary lock/unlock lever 74 are slaved together, primary lever 60 cannot be moved to the unlocked position when blocker pin 72 is in the position shown in FIG. 4.

Figure 5:
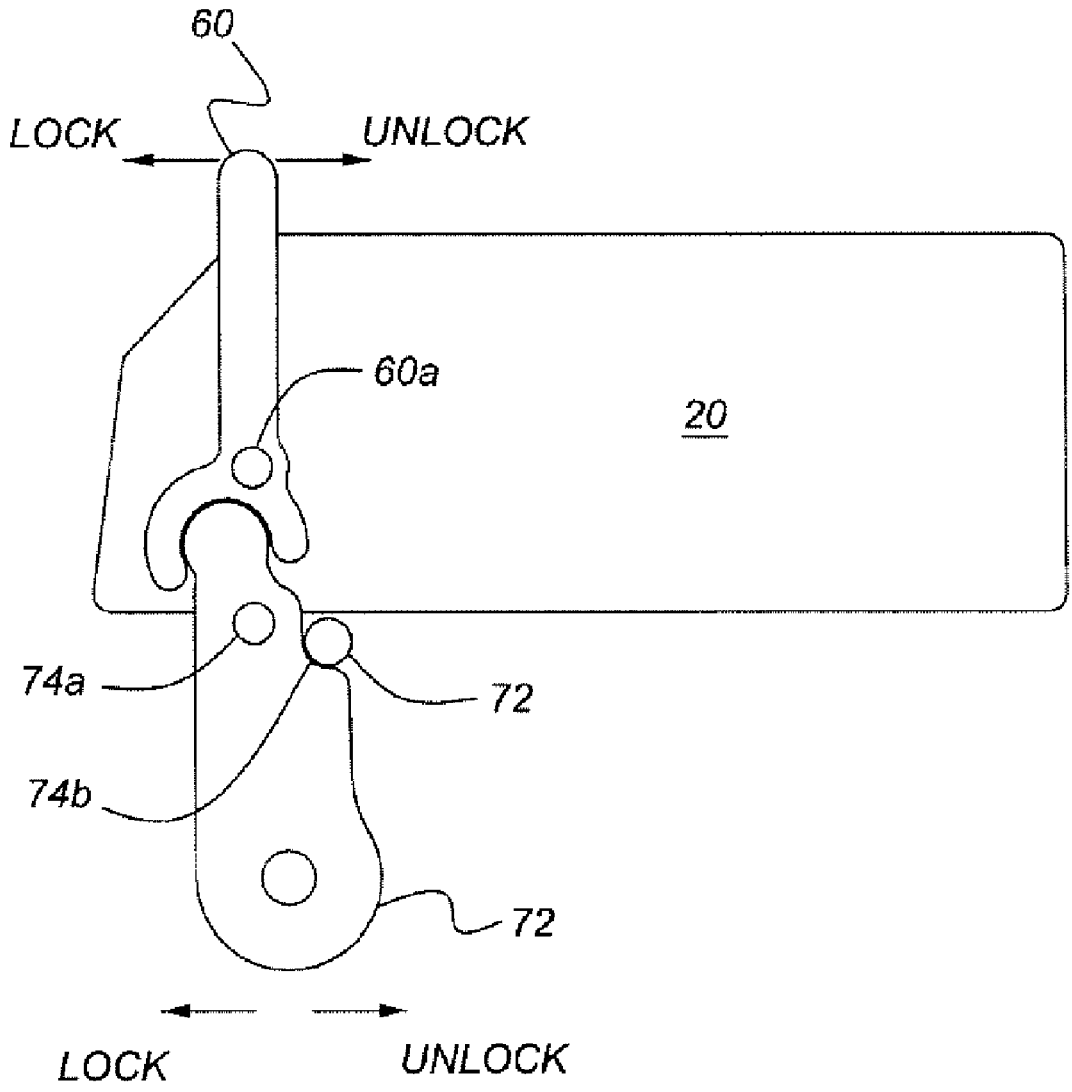
FIG. 5 is a partially schematic representation of the lock/unlock and blocking pin features of the present inventive lock mechanism.

The slaved relationship between levers 60 and 74 is shown with particularity in FIG. 5, wherein secondary lock/unlock lever 74 is shown as being pivoted upon latch assembly 20 at pivot 74*a*, and having cutout 74*b* for receiving blocker pin 72. Secondary lock/unlock lever 74 is shown in a locked position. As shown also in FIG. 5, secondary lock/unlock lever 74 meshes with primary lock/unlock lever 60, which is pivoted at 60*a* to latch assembly 20 such that the levers 60 and 74 are slaved together. An important point here is that blocker pin 72, which is responsive to primary push-pull cable 24 and slider 68, prevents unlocking of latch 20 when lock cylinder 22 is in the locked position.

As seen from the various drawings in the specification, a method for locking a door latch system of an automotive vehicle includes the steps of commanding a linear driver, such as a key cylinder having a crank and follower attached thereto, or an electric motor driving a lead screw or a electrically driven solenoid or other type of linear actuator, to actuate a push-pull cable, in this case push-pull cable 24 attached to latch assembly 20. Push-pull cable 24 moves lock/unlock lever 60 to the locked position while at the same time moving a slaved secondary lock/unlock lever to its locked position, while simultaneously moving blocker pin 72 into cutout 74*b* provided in secondary lock/unlock lever 74, such that the primary lock/unlock lever is prevented from moving to the unlocked position.

While particular embodiments of the invention have been shown and described, numerous variations and alternate embodiments will occur to those skilled in the art. Accordingly, it is intended that the invention be limited only in terms of the appended claims.

What is claimed is:

1. A door latch system for an automotive vehicle, comprising:

a latch assembly attached to a door, with said latch having a primary lock/unlock lever with a locked position and an unlocked position;

a lock cylinder extending through an outer surface of the door;

a primary push-pull cable having a first end linked to said lock cylinder and a second end linked to said primary lock/unlock lever; and a blocker pin, actuated by said push-pull cable, for engaging a portion of the latch system so as to prevent movement of said primary lock/unlock lever to said unlocked position wherein said blocker pin is carried upon a slider driven by said push-pull cable, with said slider being housed within a carrier attached to said latch assembly, and wherein said carrier comprises a channel-shaped enclosure having opposing sidewalls for supporting said slider for reciprocating motion, with said sidewalls having apertures permitting the passage of said blocker pin and a linkage terminal integral with said slider and carrying a link extending to said primary lock/unlock lever.

2. A door latch system according to claim 1, wherein said slider is linked to said lock/unlock lever.

3. A door latch system according to claim 1, wherein said portion of said latch system engaged by said blocker pin comprises a secondary lock/unlock lever pivotably mounted to said latch assembly and slaved to said primary lock/unlock lever.

4. A door latch system according to claim 3, wherein said secondary lock/unlock lever is redundantly driven by a manually accessible plunger extending through an interior surface of the door.

5. A door latch system according to claim 1, further comprising an interior latch unlocking cable attached to said slider.

6. A door latch system according to claim 5, wherein said push-pull cable and said interior latch unlocking cable are at least partially unitary.

7. A door latch system according to claim 1, further comprising an interior latch unlocking cable driven by a handle.

8. A door latch system according to claim 1, wherein said push-pull cable comprises a tubular, flexible cylindrical housing having a reciprocable metallic core extending therethrough.

9. A door latch system according to claim 8, wherein said lock cylinder is attached to a housing receiving said push-pull cable such that said lock cylinder will detach from said housing in the event that said lock cylinder is subjected to tampering.

10. A door latch system according to claim 1, wherein said lock cylinder comprises a key lock.

* * * * *